United States Patent [19]

Van Dort

[11] 4,361,218

[45] Nov. 30, 1982

[54] COIN TESTING APPARATUS

[75] Inventor: Klaas P. Van Dort, Gorinchem, Netherlands

[73] Assignee: Mars, Incorporated, McLean, Va.

[21] Appl. No.: 134,086

[22] Filed: Mar. 26, 1980

[30] Foreign Application Priority Data

Mar. 30, 1979 [GB] United Kingdom ..... 7911312

[51] Int. Cl.[3] ..... G07D 5/02

[52] U.S. Cl. ..... 194/102; 73/163; 194/99; 324/234

[58] Field of Search ..... 194/97 R, 99, 100 R, 194/100 A, 102; 73/163; 324/228, 233, 234, 236

[56] References Cited

U.S. PATENT DOCUMENTS

| | | | |
|---|---|---|---|
| 3,576,244 | 4/1971 | Ptacek et al. | 194/100 A |
| 3,837,454 | 9/1974 | Joeck | 194/100 A X |
| 3,870,137 | 3/1975 | Fougere | 194/100 A |
| 3,918,565 | 11/1975 | Fougere et al. | 194/100 A |
| 3,952,851 | 4/1976 | Fougere et al. | 194/100 A |
| 4,108,296 | 8/1978 | Hayashi et al. | 194/100 A X |
| 4,226,323 | 10/1980 | Dautremont | 194/100 A |

FOREIGN PATENT DOCUMENTS

| | | | |
|---|---|---|---|
| 913316 | 12/1962 | United Kingdom . | |
| 1255492 | 12/1971 | United Kingdom . | |
| 1261963 | 2/1972 | United Kingdom . | |
| 1265388 | 3/1972 | United Kingdom . | |
| 1272671 | 5/1972 | United Kingdom . | |
| 1403103 | 8/1975 | United Kingdom . | |
| 1536904 | 12/1978 | United Kingdom . | |
| 2055498 | 3/1981 | United Kingdom | 194/100 A |

*Primary Examiner*—Robert B. Reeves
*Assistant Examiner*—Edward M. Wacyra
*Attorney, Agent, or Firm*—Davis, Hoxie, Faithful & Hapgood

[57] ABSTRACT

A coin testing apparatus (10) comprises a coin passageway, a coin track (13) along which coins pass on their edges through the coin passageway and an inductor (16) adjacent the coin passageway. The inductor is connected in an oscillating circuit (40) so that the inductor (16) produces an oscillating magnetic field in the coin passageway. The frequency of the oscillating circuit is measured using a counter (41). A number representative of the idle frequency is stored in register (44). When a coin passes the inductor (16), the apparatus (10) detects whether the resulting frequency shift corresponds to the shift for an acceptable coin by comparing the difference between the number stored in register (44) and the number stored in counter (41) with a number previously stored in memory (48). The inductor (16) is oblong and has its major axis perpendicular to the track so that the arrangement is sensitive to variations in diameter over a large range of diameters.

16 Claims, 6 Drawing Figures

COIN TESTING APPARATUS

FIELD OF THE INVENTION

The present invention relates to a coin-testing apparatus which performs a diameter-dependent test on coins to determine whether they are genuine coins of a particular denomination or denominations.

BACKGROUND OF THE INVENTION

Of the testing devices that are used in coin-operated machines there are several different kinds in which the tests performed on the coins produce results which are dependent on the diameter of the coin under test. In our U.S. Pat. No. 3,870,137 we described an apparatus in which the coin under test rolls on an inclined track along a passageway formed between two closely-spaced plates which are themselves inclined slightly to the vertical so that the coins bear against one wall of the passageway. For each denomination of coin which the apparatus is intended to accept there is an inductor located in the wall of the passageway against which the coins bear. The inductors are circular and correspond in diameter to the coins of their respective denominations. Each is positioned in the wall at such a height above the track as to be coaxial with coins of its respective denominations when they are on the track alongside the inductor. The inductors are connected in oscillating circuits which in the absence of a coin idles at a frequency of say 300 to 400 kHz. When a coin is present alongside one of the inductors the frequency of the oscillating circuit shifts to a value which is dependent on the coin's diameter. By comparing the maximum frequency shift with standard values for acceptable coins of the respective denomination, the coin can be identified as acceptable or unacceptable for that denomination.

The inductive testing apparatus of the kind described above is sensitive to fairly small deviations in diameter from the diameter of the acceptable coin. However, the sensitivity decreases the greater the deviation from the diameter of the acceptable coin so that it becomes difficult to distinguish between two coins of slightly different diameter if the two coins are substantially larger or substantially smaller in diameter than the inductor. It is for this reason that in the apparatus described above a different inductor is used for each size of acceptable coin in order to provide a reliable test of high selectivity.

The manufacturer of coin testing mechanisms may have to supply machines which accept many different sets of coins to meet customers requirements throughout the world. It is a disadvantage in these circumstances to have to match the sizes of the inductors to the sizes of the coins in each coin set.

SUMMARY OF THE INVENTION

The object of the present invention is to provide an inductive diameter sensitive coin-testing apparatus which has a high sensitivity to variations in coin diameter over a relatively large range of coin diameters.

According to the present invention there is provided coin testing apparatus comprising a coin passageway, a coin track along which coins pass on their edges through the coin passageway, an oscillator circuit including an inductor adjacent the coin passageway which produces an oscillating magnetic field in the coin passageway, means for examining the interaction between a coin in the passageway adjacent the inductor and the oscillating magnetic field and means for determining whether the interaction corresponds to the interaction for an acceptable coin, the inductor being oblong and having its major axis substantially perpendicular to the track.

We have found that with such an arrangement the sensitivity to variations in diameter is relatively uniform over a large range of diameters and gives greater sensitivity compared with a circular inductor of diameter equal to the major axis of the oblong inductor.

By using an oblong inductor with a practical aspect ratio, the value of frequency shift, which with a circular inductor would be proportional to $D^2$, where D is the coin diameter, approaches proportionality with D.

The inductor may comprise a coil in a ferrite pot core. The coil may be in the form of an oblong circle with straight portions parallel to the major axis and a semi-circular portion joining the straight portions at each end. It may be located in a similarly shaped groove in the pot core between a peripheral ferrite wall and a centre core, also of the same shape.

The inductor should desirably be mounted so that the smallest coin which the apparatus may be required to accept overlaps the lower end of the inductor centre pole when it is on the track adjacent the inductor and the largest coin which the apparatus may be required to accept does not extend above the inductor centre pole when it is on the track adjacent the inductor. Thus, it will be evident that the angle which the major axis of the oblong inductor makes with the track can depart from the strictly perpendicular provided it remains generally transverse to the path of a coin along the track. In practice at present with the smallest coin being the 15 mm. diameter Dutch 10 cents coin and the largest being 33 mm. diameter Danish 5 Krone coin this means that in an apparatus which may be required to cater for these coins the bottom of the inductor should be less than 15 mm. and the top should be at least 33 mm. above the track. Using a ferrite pot core we have found that satisfactory results can be obtained with the peripheral wall at the bottom 4.6 mm. above the track and at the top 38.6 mm. above the track.

A further advantage of the oblong inductor is that it has a small dimension in the direction parallel to the track compared with a circular inductor which can distinguish up to the same size of coins. For example an inductor may be constructed in accordance with the present invention having a dimension perpendicular to the track of 34 mm. but a dimension parallel to the track of only 24 mm. A circular inductor which provides similar sensitivity at large diameter may be 33 mm. in diameter. This saving in space along the track can be important when designing a coin testing machine which performs other tests besides the one performed by the apparatus in accordance with the invention.

The oscillator circuit should oscillate at a high frequency, say above 75 kHz, in order that the oscillating magnetic field penetrates only the surface of the coin under test. We have found that a normal oscillating frequency of 600–700 kHz in the absence of a coin produces good results. The means for examining the interaction of the coin with the magnetic field may conveniently comprise means which examine the maximum frequency at which the circuit oscillates when a coin passes. The means determining whether the interaction corresponds to that for an acceptable coin might then comprise a comparator which compares a value representative of the maximum frequency or the maximum shift in frequency with a corresponding value for an acceptable coin.

BRIEF DESCRIPTION OF THE DRAWINGS

An embodiment of the invention will now be described, by way of example, with reference to the accompanying drawings in which.

DESCRIPTION OF PREFERRED EMBODIMENTS

Figure 1:
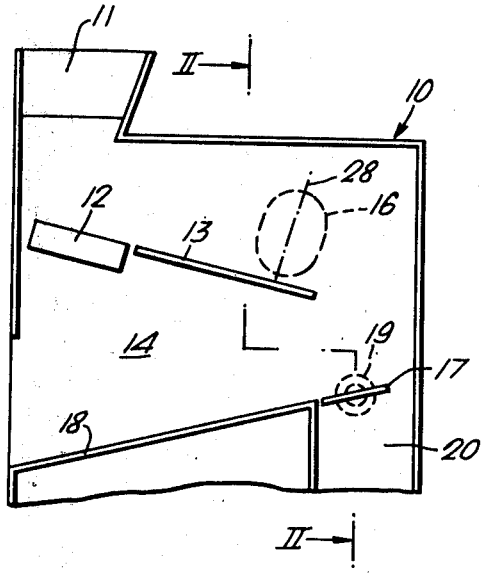
FIG. 1 shows a diagrammatic front view of a coin-testing apparatus in accordance with the invention with a front wall removed.
Figure 2:
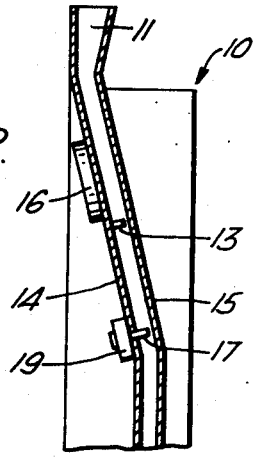
FIG. 2 shows a diagrammatic vertical section on the line II—II of FIG. 1.

Referring to FIGS. 1 and 2, a coin testing apparatus or coin selector 10 comprises a coin entry slot 11 through which coins may be inserted into the apparatus to fall onto an energy-dissipating device 12, which may be a block of sintered aluminium oxide as described in our U.S. Pat. No. 3,944,038 and which suppresses bouncing of the coin.

The energy-dissipating device forms the upstream end of an inclined coin supporting track 13 down which the coin moves on its edge under the influence of gravity.

The passageway through which the coin moves is defined by two closely-spaced plates 14 and 15. The parts of the plates which form the walls of the passageway along the track 13 are tilted at an angle of about 10° to the vertical so that coins moving down the track bear against the wall formed by the plate 14.

Adjacent the wall of the passageway against which the coins bear is an inductor 16 which forms part of a coin testing circuit. Below the downstream end of the track 13 is a coin acceptance gate 17. The gate 17 normally intercepts coins falling from the lower end of the track 13 and diverts them onto a reject coin track 18 whereby the coins are returned to the customer, but when a coin is found to be acceptable by the testing circuit the gate 17 is retracted into the wall of the passageway by means of a solenoid 19 so that the coin can fall past the gate 17 into a coin-acceptance passageway 20.

Figure 4:
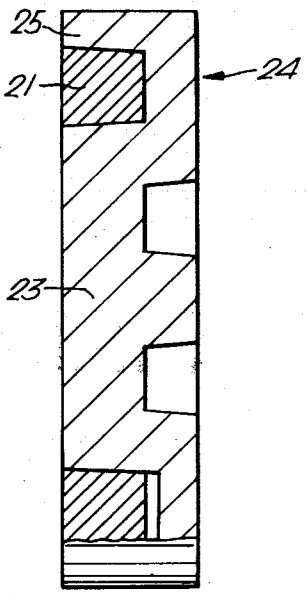
FIG. 4 shows a section of the inductor of FIG. 3 on the line IV—IV.
Figure 3:
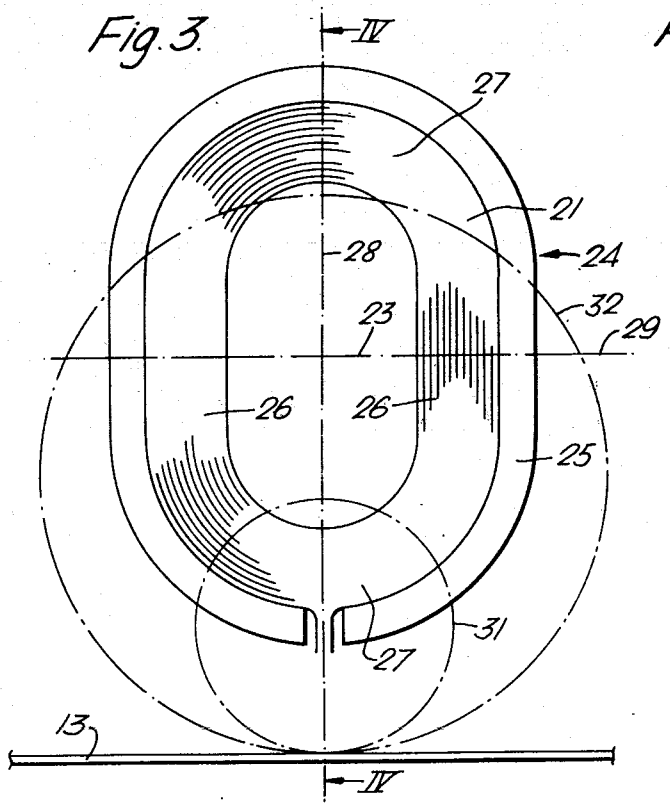
FIG. 3 shows a front view of the inductor of FIGS. 1 and 2.

The inductor 16 is shown in greater detail in FIGS. 3 and 4. It comprises a coil 21 which is placed around the centre pole 23 of a ferrite pot core 24. The pot core 24 has a peripheral wall 25 which extends around the outside of the coil 21, the coil sitting in the channel formed between the wall 25 and the centre pole 23.

The coil 21 has the form of an oblong circle comprising two parallel straight sections 26 and two semicircular sections 27 joining the straight sections at opposite ends. The central pole 23 has a corresponding oblong form with rounded ends as does the peripheral wall. The overall dimension of the pot core along its major axis 28 is 34 mm., the dimension along its minor axis 29 is 24 mm. The centre pole measures 20 mm. by 10 mm.

The inductor is positioned behind the wall of the passageway with its major axis 28 perpendicular to the coin track 13. The height of the lower end of the ferrite core 24 above the track is 4.8 mm. In this position the top of a 15 mm. diameter coin (indicated at 31) will be just above the bottom end of the centre pole when it is on the track adjacent the inductor whereas a 33 mm. diameter coin (indicated by 32) will not extend above the top of the central pole. When the coin is adjacent the inductor they are separated only by the thickness of the wall which is 1.2 mm. of glass reinforced plastics.

Figure 5:
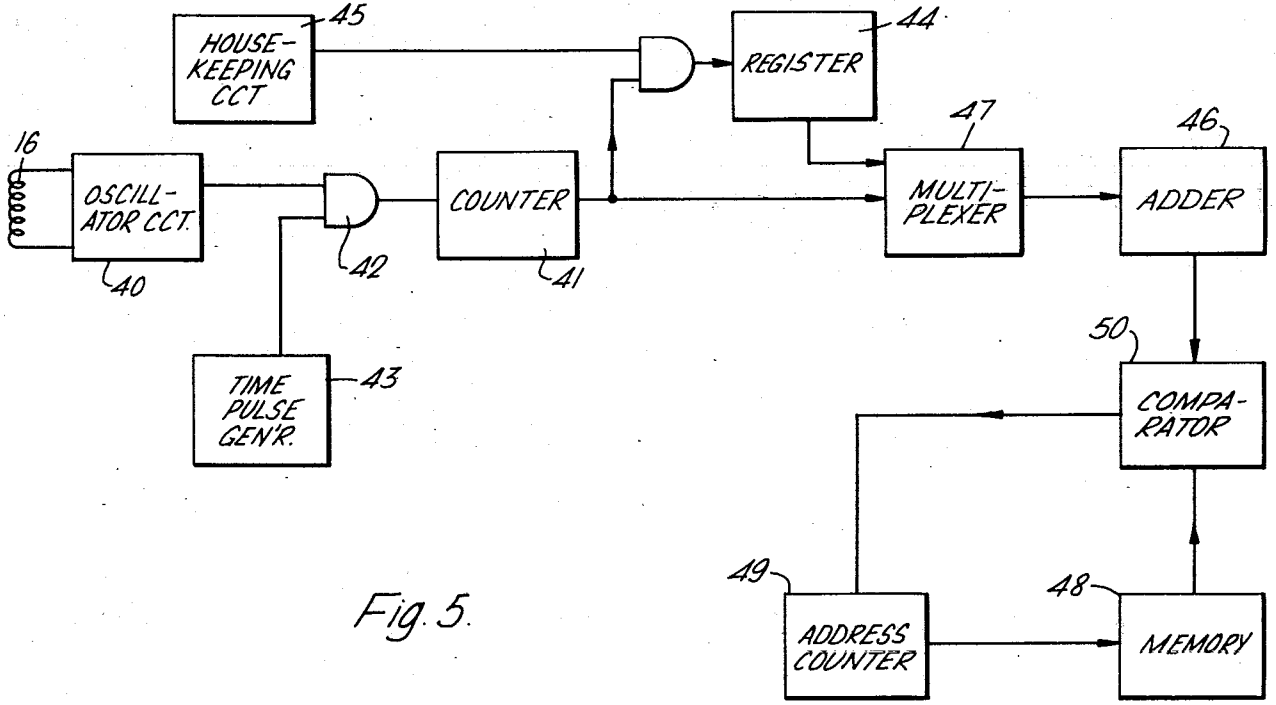
FIG. 5 shows a simplified logic diagram of the circuitry of the apparatus of FIG. 1.

Referring now to FIG. 5, the inductor 16 is connected in an oscillating circuit 40 which, in the absence of coins oscillates at a frequency of about 635 kHz. At this frequency the interaction between the coin and the magnetic field produced by the inductor is substantially independent of the thickness of the coin and depends principally on the diameter of the coin and to a lesser extent on its conductivity.

The output of the oscillator circuit 40 is fed to a circuit which measures the maximum shift in frequency from the normal idling frequency and determines whether this corresponds to certain bandwidths for acceptable coins.

The frequency of the oscillating circuit is measured using a counter 41. The oscillator circuit output is gated via an AND gate 42 into the counter 41 using a precise timing gate period of about 1 millisecond duration generated by a stable reference timing oscillator which is part of the time pulse generator 43.

A number corresponding to the idle frequency in the absence of the coin is stored in a register 44. This number is stored when a housekeeping circuit 45 produces signals either just after the power is first applied to the coin testing apparatus or when the testing apparatus has just rejected a coin. The reference value is fed into the register 44 from the counter 41 when the appropriate housekeeping pulse is received. By means of this periodic updating of the idle frequency reference value, small changes of idling frequency can be tolerated without affecting the overall performance of the apparatus.

The contents of the counter 41 and the register 44 are periodically transmitted to an adder 46 by a multiplexer 47. The adder 46 determines the difference between the number in the counter 41 and the number in the register 44. At the end of each 1 millisecond examination period, the output of the adder 46 is compared with a number previously stored in a memory 48. The address of the number read from the memory to the comparator 50 is determined by an address counter 49. Whenever the number in the adder 46 exceeds the number in this memory location, the address counter is advanced by one count to the next address. The address in the counter 49 is then transmitted to the memory 48.

The numbers stored in the memory 48 are the numbers corresponding to the lower and upper frequency difference levels associated with each acceptable coin. Thus as the coin passages through the field of the inductor 16 the frequency of the oscillator will rise above the frequency produced in the absence of the coins, the frequency difference counter from the adder 46 will rise through the levels set in the memory 48, and the address counter 49 will advance in count to an address corresponding to the frequency difference level next above the maximum frequency difference which is produced. If this address represents the upper level of a frequency difference band associated with a valid coin, then it means that the maximum frequency difference was within an acceptance band. If however this address corresponds to the lower level of an acceptance band it means that the coin caused the frequency difference to rise to a value outside a valid acceptance band and therefore should be rejected. Thus the number in the address counter is indicative of whether the test has identified the coin as acceptable and also the denomination of the coin.

In practice the testing apparatus may also perform other tests on the coin such as are described in our U.S. Pat. Nos. 3,870,137 and 3,918,565. To provide sufficient space along the track for the testing apparatus, more than one inclined coin track may have to be used with a snubber at the top of each track and the acceptance gate below the lower end of the lowermost track. The results of the tests will be combined so that the coin is accepted only if the results of all tests indicate an acceptable coin of the same denomination.

It will be appreciated from the foregoing description that the testing apparatus can readily be adapted for different sets of coins. All that must be changed are the values stored in the memory representative of the upper and lower limits for the acceptance bands of the particular coins. If the memories are pre-programmed memories such as are described in our U.S. Pat. No. 1,527,450, all that has to be done to change the coin set which the apparatus will accept is to replace the pre-programmed memory.

Figure 6:
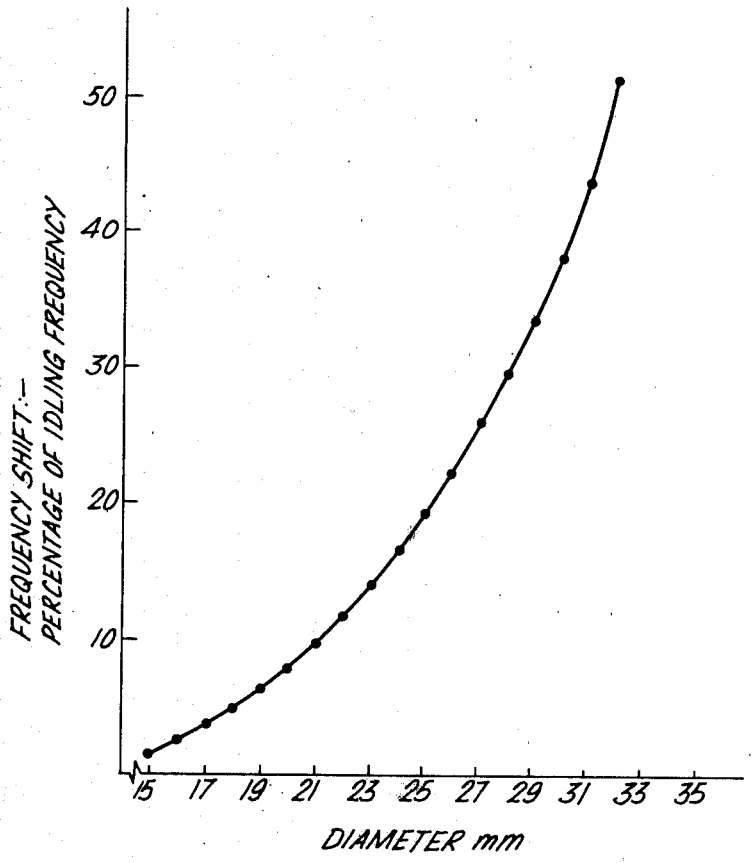
FIG. 6 is a graph showing the results of tests in which the frequency shift has been measured for different diameters of coin.

FIG. 6 shows a graph of experimental results obtained on a testing apparatus as described above indicating the frequency shift produced by different diameters of coin. As will be seen from the graph the apparatus produces a fairly uniform rate of change of frequency shift over a large range of coin diameters.

I claim:

1. A multidenomination coin testing apparatus for performing a diameter sensitive test on coins, said apparatus having a relatively high sensitivity to variations in coin diameter over a relatively large range of coin diameters, said apparatus comprising a coin passageway, a coin track along which coins pass on their edges and substantially in a predetermined plane through the coin passageway, and inductive coin examining means arranged to produce an oscillating magnetic field in the coin passageway and to respond to the interaction between a coin travelling in the passageway and the oscillating magnetic field, the coin examining means including an inductor adjacent the coin passageway connected in a coin acceptability testing circuit arranged to determine whether the interaction corresponds to the interaction for an acceptable coin, the inductor comprising a coil which is oblong, has the major axis of its oblong shape substantially parallel with said plane and transverse to the path of a coin along the track, is located alongside the passageway, and has the axis of the magnetic field directed through said plane, the inductor being arranged with the lower edge of its coil spaced above the coin track.

2. An apparaus according to claim 1, wherein the inductor comprises a coil in a ferrite pot core and said coil is substantially oval with straight portions parallel to its major axis and a semi-circular portion joining the straight portions at each end.

3. An apparatus according to claim 2, wherein the coil is in a similarly shaped groove in the pot core between a peripheral ferrite wall and an oval central pole piece.

4. An apparatus according to claim 3, wherein the inductor is so arranged that the smallest coin which the apparatus is required to accept overlaps the lower end of the central pole piece of the inductor when the coin is on the track adjacent the inductor and the largest coin which the apparatus is required to accept does not extend above the central pole piece of the inductor when it is on the track adjacent the inductor.

5. An apparatus according to claim 3, wherein the peripheral wall at the bottom is 4.6 mm. above the track and at the top is 38.6 mm. above the track.

6. An apparatus according to claim 1, wherein the bottom of the inductor is less than 15 mm., and the top is at least 33 mm., above the track.

7. An apparatus according to claim 1, wherein the oscillator circuit oscillates at a frequency above 75 kHz, in order that the oscillating magnetic field is concentrated mainly at the surface of the coin under test.

8. An apparatus according to claim 7, wherein the oscillating circuit has a normal oscillating frequency of 600–700 kHz in the absence of a coin.

9. An apparatus according to claim 1, wherein the means for examining the interaction of the coin with the magnetic field comprise means for sensing the frequency of the oscillator when a coin passes.

10. An apparatus according to claim 9, wherein the means for determining whether the interaction corresponds to that for an acceptable coin comprises a comparator which compares a value representative of the maximum frequency with a maximum value for an acceptable coin.

11. An apparatus as claimed in claim 10, wherein the comparator compares said representative value with a plurality of maximum value bands for respective acceptable coins.

12. An apparatus as claimed in claim 10, wherein the comparator compares the instantaneous frequency of the oscillator sequentially with a plurality of stored values which, in turn, define the lower and upper limits of maximum value bands for respective acceptable coins, and means is provided for recognising which of the stored values is the highest reached by the instantaneous frequency or frequency shift, this being indicative of whether or not the maximum lies within an acceptable coin band.

13. An apparatus according to claim 1, wherein the means for examining the interaction of the coin with the magnetic field comprise means for sensing the frequency shift of the oscillator when a coin passes.

14. An apparatus according to claim 13, wherein the means for determining whether the interaction corresponds to that for an acceptable coin comprises a comparator which compares a value representative of the maximum shift in frequency with a maximum value for an acceptable coin.

15. An apparatus as claimed in claim 14, wherein the comparator compares said representative value with a plurality of maximum value bands for respective acceptable coins.

16. An apparatus as claimed in claim 14, wherein the comparator compares the instantaneous frequency shift of the oscillator sequentially with a plurality of stored values which, in turn, define the lower and upper limits of maximum value bands for respective acceptable coins, and means are provided for recognising which of the stored values is the highest reached by the instantaneous frequency of frequency shift, this being indicative of whether or not the maximum lies within an acceptable coin band.

* * * * *